United States Patent [19]

Leff

[11] 4,093,497

[45] June 6, 1978

[54] SELF RETRACTING STRIPPER FINGER FOR CORRUGATING MACHINE

[75] Inventor: Martin J. Leff, New York, N.Y.

[73] Assignee: S&S Corrugated Paper Machinery Co., Inc., Brooklyn, N.Y.

[21] Appl. No.: 796,188

[22] Filed: May 12, 1977

[51] Int. Cl.[2] ..... B31F 1/00

[52] U.S. Cl. ..... 156/473

[58] Field of Search ..... 156/205, 210, 470, 472, 156/473

[56] References Cited

U.S. PATENT DOCUMENTS

| | | | |
|---|---|---|---|
| 3,484,320 | 12/1969 | David | 156/473 |
| 3,630,806 | 12/1971 | Kitajima et al. | 156/472 |
| 3,951,725 | 4/1976 | Bradley et al. | 156/473 |
| 4,038,130 | 7/1977 | Cosby et al. | 156/473 |

*Primary Examiner*—David A. Simmons
*Attorney, Agent, or Firm*—Ostrolenk, Faber, Gerb & Soffen

[57] ABSTRACT

In a single facer having split blades for stripping a corrugated medium from one of the corrugating rolls and then guiding the corrugated medium to a pressure nip where a liner is applied thereto, the blade sections are biased toward the corrugating medium by a single spring which acts through blade holding cranks so constructed that retracting the upstream blade section against the force of the biasing spring automatically retracts the downstream blade section against the force of the biasing spring thereby minimizing interference between the downstream blade section and a thickened web portion.

10 Claims, 6 Drawing Figures

SELF RETRACTING STRIPPER FINGER FOR CORRUGATING MACHINE

This invention relates to single facers in general and more particularly relates to novel means for mounting the stripper fingers.

In prior art single facer corrugators the corrugated medium is guided by a plurality of generally parallel axially spaced fingers between the corrugation forming nip and the pressure nip where the liner is applied. To compensate for variations in web thickness, the guide fingers or blades are sometimes resiliently mounted and as a further improvement each blade is split transversely. The blade sections are mounted in tandem and individually biased toward the corrugated medium. The latter arrangement is shown in U.S. Pat. No. 3,484,320 issued Dec. 16, 1969 to C. H. A. David for Machines For The Making Of Corrugated Board, and in U.S. Pat. No. 3,951,725 issued Apr. 20, 1976 to W. J. Bradley, Jr. and W. A. Nikkel for Two Piece Stripper Finger For Corrugating Machine.

In prior art devices of this type, outward deflection of the upstream blade section has no effect upon the downstream blade section so that when the thickened web portion which caused the upstream section to retract reaches the downstream blade section, there is high impact engagement in that the lead edge of the downstream section does not have a counter-radius to permit gradual engagement. In fact, if an effective counter-radius were to be provided at the lead end of the downstream blade section, this would provide an unwanted gap during normal operation.

As will hereinafter be seen, the instant invention provides resiliently mounted blade sections biased toward the corrugated medium with the mounting being such that the retraction of the upstream blade section results in automatic retraction of the downstream blade section without impact.

Accordingly, a primary object of the instant invention is to provide a novel mounting for split stripper blades of a single facer.

Another object is to provide a mounting of this type in which retraction of the upstream blade section automatically retracts the downstream blade section.

Still another object is to provide a mounting of this type in which a single tension spring biases both of the blade sections toward normal positions.

These objects as well as other objects of this invention shall become readily apparent after reading the following description of the accompanying drawings in which:

FIG. 2 is a side elevation illustrating the split stripper-guide blade mounting means constructed in accordance with teachings of the instant invention.

Figure 4:
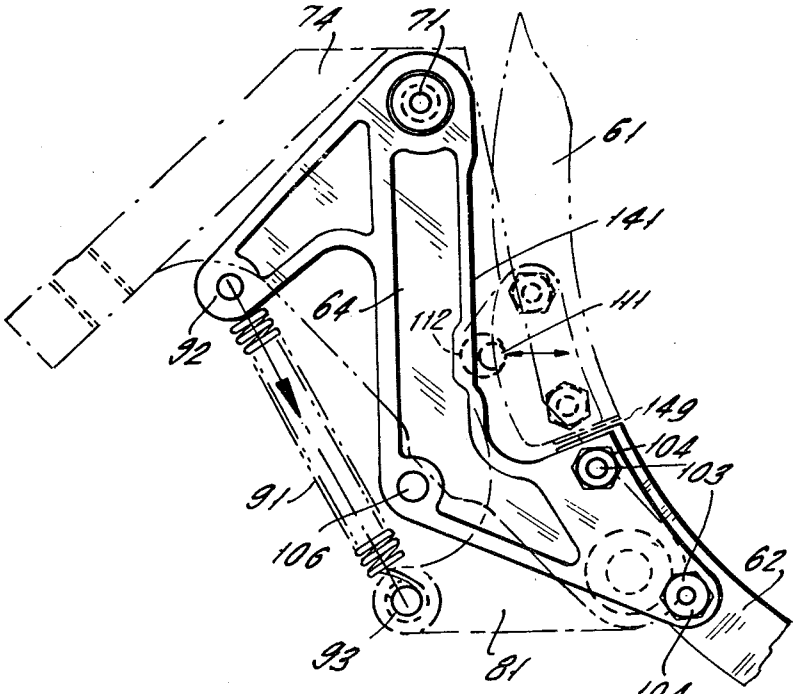
FIG. 4 is a side elevation of the support member for the blade sections.
Figure 3:
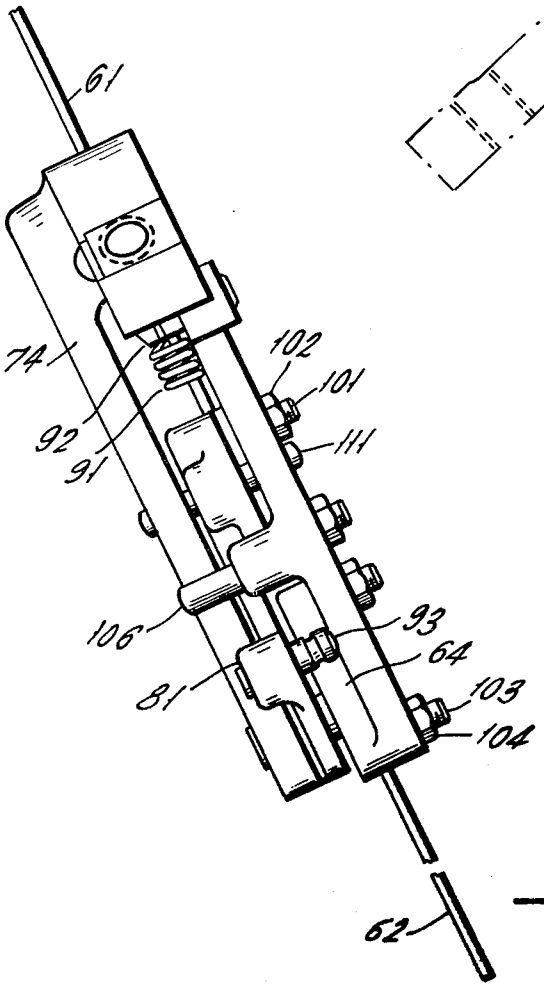
FIG. 3 is an end view of the blade mounting means looking in the direction of arrows 3—3 of FIG. 2.
Figure 5:
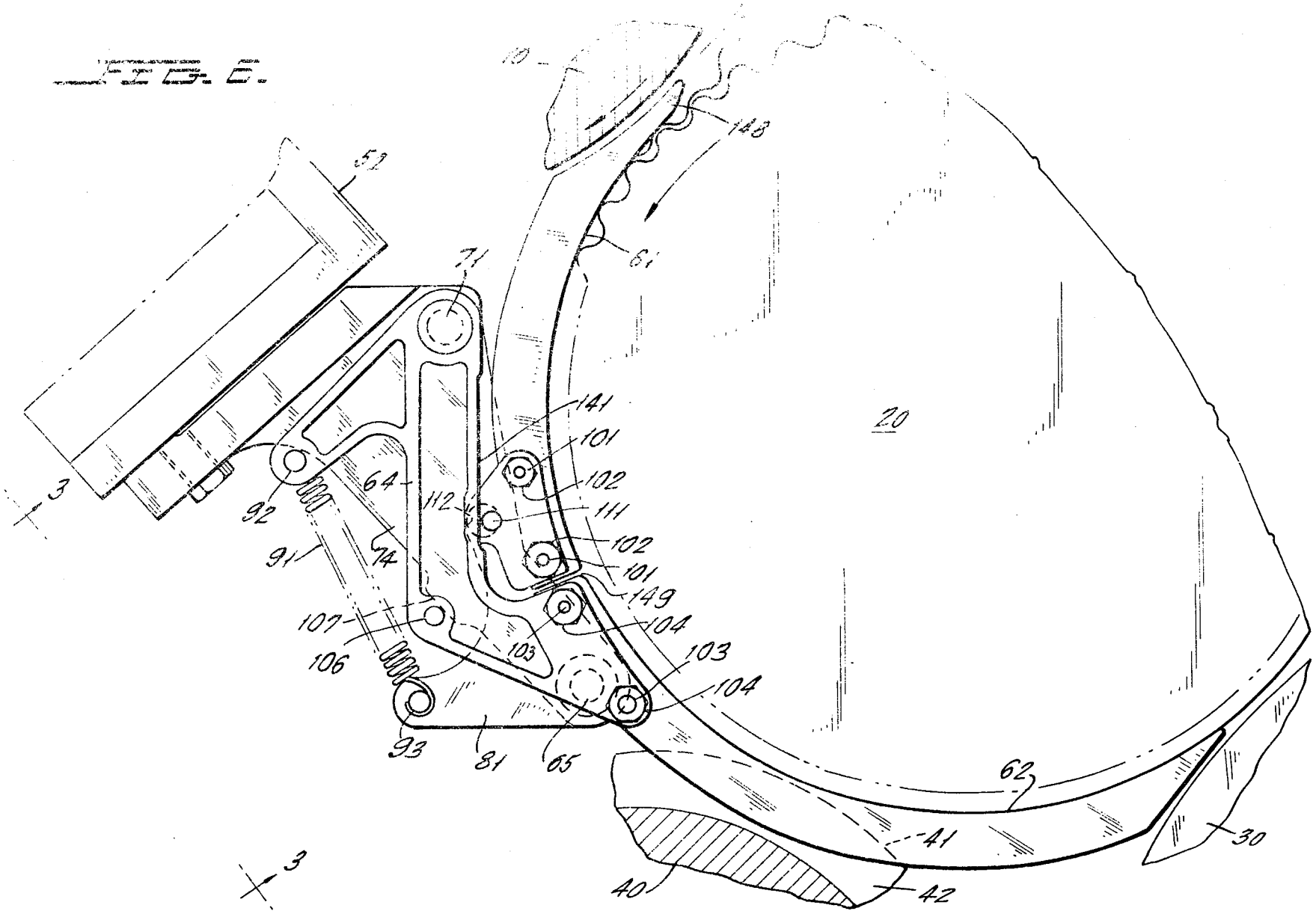
FIG. 5 is a side elevation of the holder for the lower blade section.
Figure 6:
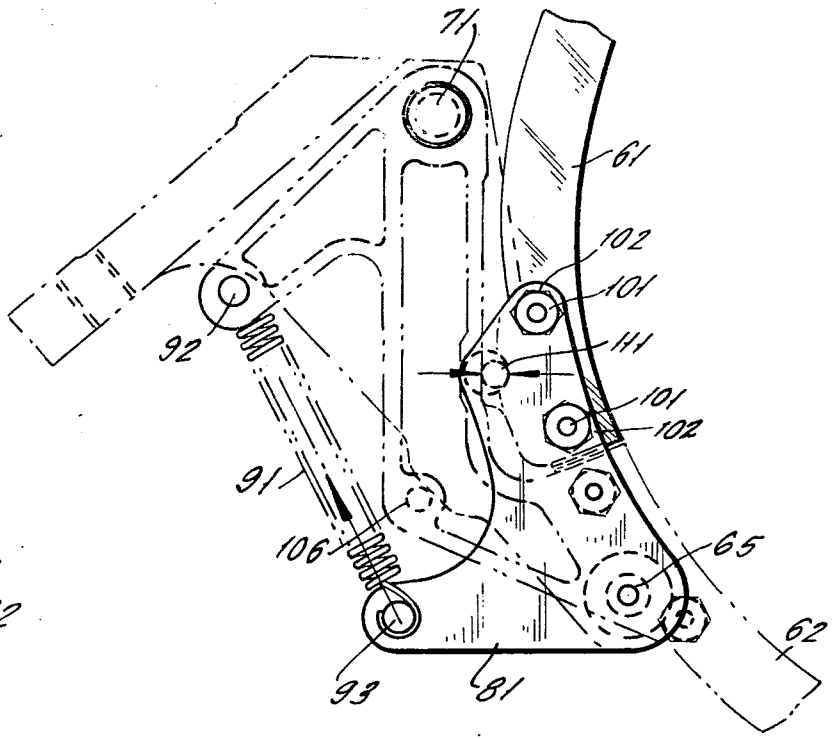
FIG. 6 is a side elevation of the holder for the upper finger section.
Figure 5:
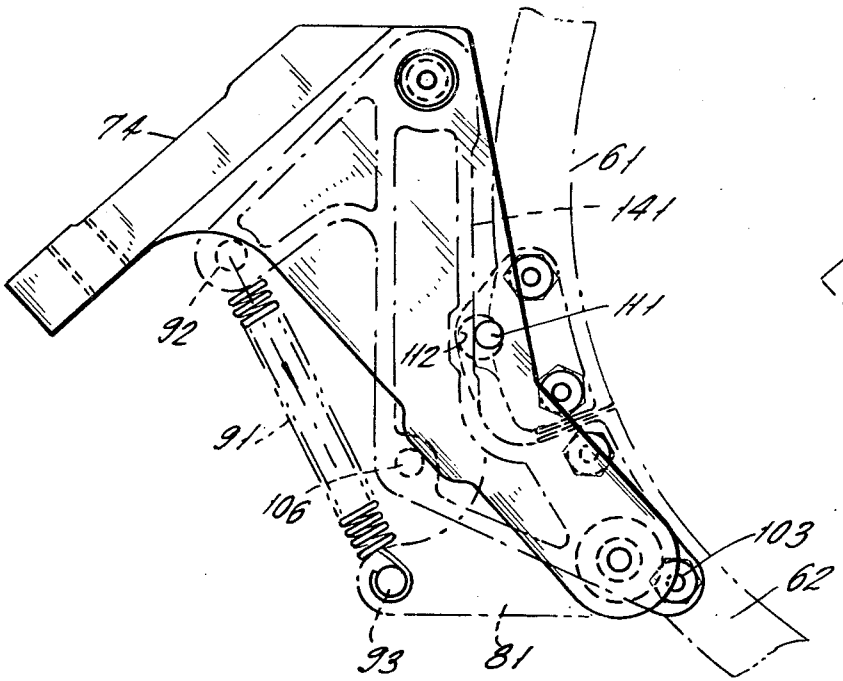

In FIGS. 4, 5 and 6 related elements are drawn in phantom.

Figure 1:
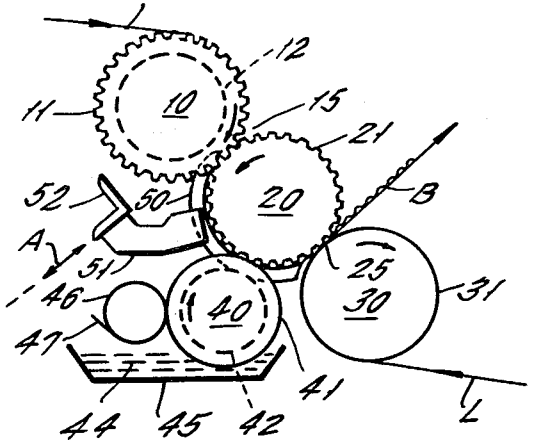
FIG. 1 is a schematic illustration of a prior art single facer.

Now referring to FIG. 1 showing a typical prior art corrugator which does not utilize split stripper-guide fingers. In particular, the corrugator of FIG. 1 includes upper and lower corrugating rolls 10, 20 mounted for rotation on horizontal axes in the directions indicated by the arrows thereon. The outer surfaces 11, 21 of the respective rolls 10, 20 are longitudinally fluted with these flutes being in mesh at corrugation forming nip 15 through which the flat paper web or corrugating medium M is directed. After passing through nip 15 medium M is corrugated and is stripped from upper roll 10 and directed around lower roll 20 to pressure nip 25 where liner L is applied to corrugated medium M to form single faced board B. In the region between nips 15 and 25 glue is applied to the exposed tips of corrugated medium M by glue roll 40 whose periphery 41 passes into glue pool 44 in reservoir 45. Doctor blade 47, operatively disposed adjacent to the periphery of metering roll 46 which in turn is disposed adjacent the periphery of glue roll 41, acts to control the amount of glue applied by roll 40 to corrugated medium M.

In the region between nips 15 and 25, corrugating medium M is held within the flutes of lower corrugating roll 20 by crescent shaped stripper-guide blade or finger 50 secured to holder 51, which in turn is secured to frame member 52. The latter is adjustably mounted in the directions indicated by double headed arrow A. Relief grooves 12, 42 are formed in the outer surfaces of the respective rolls 10, 40 to provide clearances for finger 50. A plurality of fingers 50 are mounted in spaced parallel relationship to frame member 52 by individual holders 51. At pressure nip 25 liner L is forced against corrugating medium M by the periphery 31 of pressure roll 30.

While the intent of fingers 50 is to maintain the flutes of corrugating medium M as deeply within the flutes of lower corrugating roll 20 as possible, the adjusted position of finger 50 must be such as to compensate for thickness variations in medium M, especially the great variation in thickness at splices in medium M. In accordance with the instant invention, relatively great thickness variations in the corrugating medium M are compensated for by the construction illustrated in FIGS. 2 through 6. In particular, these Figures show that each of the crescent shaped fingers is constructed of two arcuate finger or blade sections 61, 62 in tandem end to end alignment. Screws and nuts 101, 102 secure upstream finger section 61 to blade holder 81. Pin 65 pivotally mounts holder 81 to support member 74 which is secured to frame member 52. Screws and bolts 103, 104 secure downstream finger section 62 to holder 64 which is pivotally mounted at pin 71 to support 74.

The opposite ends of coiled tension spring 91 are secured to pins 92, 93 projecting from the respective holders 64, 81 at locations such that holder 64 is biased counterclockwise about pivot 71 and holder 81 is biased clockwise about pivot 65. Thus, both upstream and downstream finger sections 61, 62 are biased toward the periphery of lower corrugating roll 20 by single spring 91. Pin 106 projecting from holder 64 engages support surface 107 to limit inward movement of lower finger section 62. Similarly projection 111 extends from holder 81 into oversized aperture 112 of support 74 to limit inward movement of upper finger section 61.

When a thickened portion of medium M passes through nip 15, leading finger section 61 is retracted or pushed away from the periphery of downstream corrugating roll 20 thereby moving pin 111 to the left with respect to FIG. 2, and in so doing projection 111 engages edge 141 of holder 64 to pivot the latter clockwise about its pivot 71. This automatically moves trailing finger section 62 away from the periphery of lower corrugating roll 21 in anticipation of engaging the thickened section of corrugating medium M as it passes between finger section 62 and lower corrugating roll 20.

Thus, it is seen that the instant invention utilizes a single tension spring to bias individually mounted stripper finger sections toward holding position urging the corrugated medium M to remain in full engagement with lower corrugating roll 20. The mounting of the finger section is such that when the lead finger section confronts a thickened web, the lower finger section will automatically be moved away from its web holding position. It is noted that the upstream end 148 of upstream section 61 is curved to form a tapered relatively wide mouthed opening for corrugated medium M as it enters between blade section 61 and roll 20. On the other hand, the upstream end 149 of downstream blade section 62 is relatively sharp but does not interfere with a thickened section of web since blade section 62 is retracted before the thickened web section reaches the downstream section 62.

Although there has been described a preferred embodiment of this invention, many variations and modifications will now be apparent to those skilled in the art. Therefore, this invention is to be limited, not by the specific disclosure herein, but only by the appended claims.

What is claimed is:

1. Web corrugating apparatus including first and second rotating corrugating rollers operatively in mesh at a corrugating nip through which a flat web passes to be transformed into a corrugated web, a pressure roll operatively disposed adjacent said first corrugating roll at a pressure nip through which the corrugated web and another flat web pass and are joined to form single faced board, a plurality of transversely spaced finger means having arcuate surfaces operatively positioned to support the corrugated web in the region between said nips, each of said finger means including an upstream and a downstream section generally aligned in a plane parallel to the rotational axis of the corrugating rollers, biasing means urging arcuate surfaces of said sections toward said first corrugating roll, a first and a second holder to which the respective upstream and downstream sections are secured, a support to which said holders are movably mounted, and means operatively connecting said holders whereby movement of said first holder in a blade retracting direction is transmitted to said second holder to move the latter in a direction to retract said downstream blade.

2. Web corrugating apparatus as set forth in claim 1 in which the biasing means comprises a common spring acting on both of said holders.

3. Web corrugating apparatus as set forth in claim 1 in which both of said holders are pivotally mounted on said support.

4. Web corrugating apparatus as set forth in claim 1 in which the biasing means urges the first and second holders to pivot in opposite directions.

5. Web corrugating apparatus as set forth in claim 1 in which the arcuate surface of the upstream section is undercut at the upstream end thereof and there is a relatively sharp corner at the upstream end of the arcuate surface of the downstream section.

6. Web corrugating apparatus as set forth in claim 1 in which there is a stop means limiting movement of said arcuate surfaces of said sections toward said first corrugating roll.

7. Web corrugating apparatus as set forth in claim 2 in which the biasing means urges the first and second holders to pivot in opposite directions.

8. Web corrugating apparatus as set forth in claim 7 in which there is a stop means limiting movement of said arcuate surfaces of said sections toward said first corrugating roll.

9. Web corrugating apparatus as set forth in claim 8 in which the arcuate surface of the upstream section is undercut at the upstream end thereof and there is a relatively sharp corner at the upstream end of the arcuate surface of the downstream section.

10. Web corrugating apparatus as set forth in claim 9 in which the common spring is a coiled tension member connected at opposite ends thereof to the respective first and second holders.

* * * * *

UNITED STATES PATENT AND TRADEMARK OFFICE

CERTIFICATE OF CORRECTION

PATENT NO. : 4,093,497

DATED : June 6, 1978

INVENTOR(S) : Martin J. Leff

It is certified that error appears in the above-identified patent and that said Letters Patent are hereby corrected as shown below:

Claim 1, column 3, line 42 - delete "parallel" and substitute therefor --perpendicular--

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*